United States Patent [19]

Warehime

[11] Patent Number: 5,072,936

[45] **Date of Patent: * Dec. 17, 1991**

[54] MAGNETIC MARBLES STACKING GAME AND APPARATUS

[76] Inventor: Norwood R. Warehime, 2021 Schuster Rd., Jarrettsville, Md. 21084

[ * ] Notice: The portion of the term of this patent subsequent to Mar. 17, 2008 has been disclaimed.

[21] Appl. No.: 422,743

[22] Filed: Oct. 17, 1989

[51] Int. Cl.[5] ..... A63F 9/00

[52] U.S. Cl. ..... 273/450; 273/1 GF

[58] Field of Search ..... 273/1 GD, 1 GF, 1 M, 273/126 A; 434/301; 446/129, 137, 92, 131, 138

[56] References Cited

U.S. PATENT DOCUMENTS

| | | | |
|---|---|---|---|
| 3,077,696 | 2/1963 | Barnett et al. | 434/301 X |
| 3,278,011 | 10/1966 | Viemeister | 446/129 X |
| 3,406,972 | 10/1968 | Wong | 446/137 R |
| 3,555,475 | 1/1971 | Szczepanski | 273/1 M X |
| 3,706,158 | 12/1972 | Jensen | 446/92 |
| 4,021,042 | 5/1977 | Sweeton | 273/1 M X |

OTHER PUBLICATIONS

H. Fishlove & Co. Advertising Circular, 3-1965, Lunaballs .

*Primary Examiner*—Paul E. Shapiro

[57] ABSTRACT

The invention relates to a board and table type of game in which competing players take turns in stacking small magnetic marbles or magnetic game pieces on to a small elevated base to see how many they can stack before a fall occurs. The magnetic marbles and game pieces contain magnets which exert magnetic fields well beyond their physical bodies and can both assist and hamper players in making good scores trying to place the maximum number of marbles or game pieces on the base. Various sizes of bases and various game playing formats are offered.

6 Claims, 1 Drawing Sheet

MAGNETIC MARBLES STACKING GAME AND APPARATUS

The invention relates to magnetic marbles stacking game and apparatus therefor which is used as a medium for competitive entertainment in the field of board and table games. Players stack small magnetic marbles onto an elevated receiving base that has recessed surface on top until one or more marbles fall from base. Attracting and repelling forces of the magnetic marbles on each other make this task an interesting and challenging game. Player that stacks most marbles onto base before a fall occurs is winner. Several types of elevated base items are suggested. Also, several game play variations are possible.

Subject invention is somewhat analogous to the old saying about "the straw that broke tha camel's back". Search revealed no relevant game in prior art using magnetic marbles as subject game. Search did reveal a stacking game that uses plastic pigs that are stacked some what like the marbles in subject invention. Reference is made to the 1989 catalogue, page 26 of the firm of Peter Pan Playthings Ltd., of Bretton Way, Bretton, Peterborough, England. In this game, the players spin a wheel which determineshow many and what types(s) of pig(s) of several possible types that players receive to test their skill at placing them on the elevated base used in the game. For each pig stacked, players receive one point, but no points are awarded if any pig falls off the base. Winner is first player to stack ten pigs. This stacking game depends mostly on the inter-locking surface features of the pigs. No magnetism is involved.

Subject invention is a refinement and extension on the prior art in that it brings into play the invisible attracting and repelling forces of the magnetic marbles which can cause strange and unexpected happenings when players are placing or trying to place the marbles onto the growing stack atop the elevated base. Just when a player thinks that he can place a marble in a certain location on the stack, the marbles can come tumbling down in a lengthy chain formed by the attracting forces between the magnetic marbles, thus costing player a multiple negative score count. Also, sometimes the repelling forces block the placement of marbles in certain locations on the stack and can cause movement in general that can cause marbles to fall. Strange overhanging chains of marbles can be formed beyond rim of elevated base. Players then try to counter-balance this by adding marbles to the opposite side of the stack. But eventually there will be a fall that can end game play and cost player points. No prior art was seen to offer these refinements and extension features to the stacking games.

The invention discloses how a simple board and table type game can be played using small magnetic marbles and an elevated base having a slightly recessed top surface. The magnetic marbles are small, about the same size as common glass marbles. However, subject marbles have magnetic fields that extend well beyond the surface of the marbles and can allow unusual stacking formations. Various types of elevated bases are suggested. A simple base can be made of plastic or glass taking the shape of a small drinking cup, but cup is used in an inverted position. A shallow recessed area on the top of the base (or the bottom of the cup) is needed to hold the several marbles that are used to start the stacking process. Base can also be in form of a spool, with spool placed in a vertical orientation, and with top surface of the upper spool disc having a shallow recessed area. Such a spool uses other disc as a lower resting base for spool when stem of spool is in a vertical position. The spool type base can be made in three parts to facilitate packaging and to permit interchanging of the size of the recessed area disc for game play variation. The two spool discs would have receiving holes for attachment of the elongated connecting stem. Secure attachment could be by threads or friction fitting. Game is played by players placing magnetic marbles on base until a fall of marbles occurs. Various game play formats are possible.

Referring to the drawings.

Figure 1:
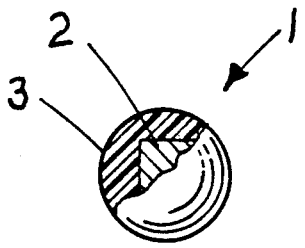
FIG. 1 is a partial view of a magnetic marble showing magnetic core and plastic outer portion.

FIG. 1 shows magnetic marble 1, with cut revealing magnetic core 2 and plastic outer portion 3. Polarity of magnetic field is not revealed. Typical marble 1 has diameter of about 11/16" (17 mm).

Figure 2:
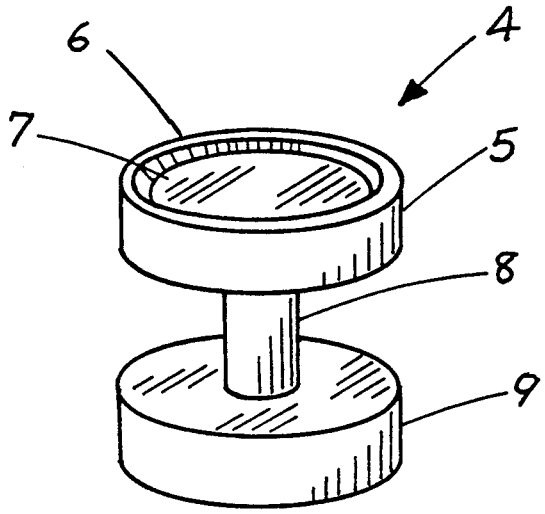
FIG. 2 is a perspective view of a spool type elevated stacking base for receiving marbles.

FIG. 2 shows a spool type stacking base 4, with upper spool disc 5, upper spool disc rim 6, and recessed area 7 for receiving marbles, spool stem 8, abd resting disc 9. Discs 5 and 9 can have central holes on flat sides to receive ends of stem 8 if a 3-piece stacking base is desired. Size of upper spool disc 5 and recessed area 6 can be varied to vary stacking capacity in game play. A typical base is about 2½" (64 mm) high.

Figure 3:
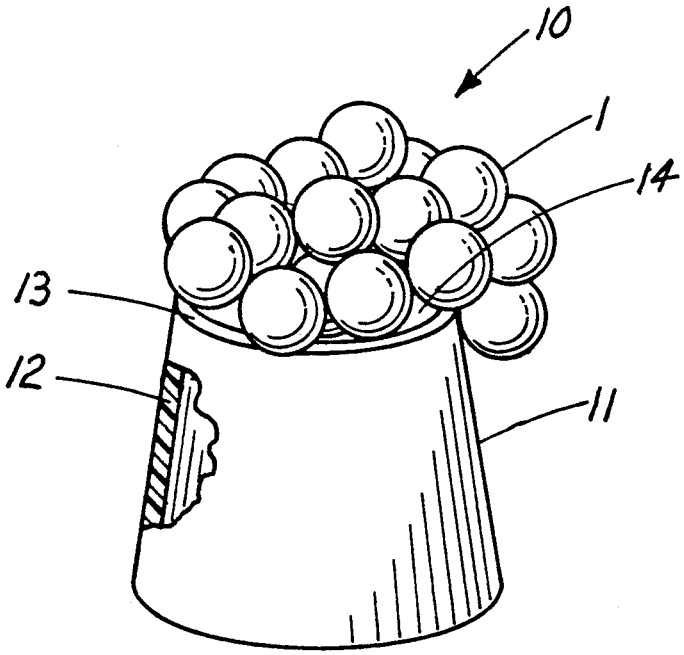
FIG. 3 is a perspective view of magnetic marbles on a inverted cup type base during game play. Cut portion of base shows plastic wall.

FIG. 3 shows general arrangement 10 of marbles 1 stacked on a cup type base during game play, with conical cup wall 11, cut portion of wall 11 revealing wall section 12, base rim 13, and general recessed area 14 on top surface of inverted cup. Game is played by two to four players, or more using certain formats. A typical game of four players is as follows. Using a total of 24 magnetic marbles 1, each player receives 6 marbles. A playing order is decided. First player places a marble in the recessed area at top base. Other players follow in order. After the first round of play, care must be taken in placing and stacking marbles since recessed area is full. Play continues in order until a fall of marble(s) occurs. Usually, a base recessed area with low rim wall that holds four initially placed marbles, will tolerate up to about 10 or 12 marbles before stacking dificulties occur. After that, extra care in stacking is required to avoid a fall. If a fall does occur, the fallen marbles are counted and represent negative score count for player causing fall. Fallen marbles are set aside and players continue stacking in their proper order. All fallen marbles are scored against players causing falls until all 24 marbles are played. A series of such game rounds are played, and player with lowest score is winner. Certain playing rules specify exact way in which marbles are to be placed on stack without disturbing them. For skilled players and for larger recessed area on base, total number of marbles used in game can be increased to 28 or 32, or more. Another format of game play is as follows. Individual players take turns and see how many marbles they can stack using a total, say of 24 marbles. In this format, the individual has full control of the stacking and he or she can carefully place the marbles for maximum stacking. If one or more marbles fall, the player can continue but the fallen marbles will be deducted from the total number of marbles in the final stack. The player can stop at any time, especially if things look insecure and there is a possibility of the whole stack falling, which does occur occasionally. Other players try their luck and keep score count in the same manner. After a series of game rounds, player with highest score count is winner. Other playing formats are possible, in general follow same lines as the formentioned games.

Although particular embodiments of the invention have been illustrated in the accompanying drawings and discussed in the foregoing description, it is understood that the invention is not limited to the embodiments disclosed, but is intended to embrace any alternatives, modifications, and rearrangements and/or substitutions of parts, elements, and formats that fall within the spirit and scope of the invention.

What is claimed is:

1. Magnetic marbles stacking game and apparatus therefor, for individuals and competing players, comprising:

an upright support structure means used to form an elevated, shallow recessed area with general horizontally orientated surface surface and surrounding rim, suitable for receiving small spherical game pieces;

a plurality of spherical magnetic marbles suitable for use as game pieces, with each of said marbles exerting a magnetic field strong enough to attract and attach to other of said marbles in the immediate vicinity;

whereby said players, following rules of game play, can compete with other players in a number of game variations in which players take turns in seeing how many of said marbles they can stack onto and above said recessed area of said support structure means before a fall of any of said marbles from said stack arrangement occurs, with player stacking the most of said marbles before said fall occurs being winner.

2. Magnetic marbles stacking game and apparatus therefor as in claim 1, wherein said support structure means is a spool formed by two discs, generally parallel and connected by a stem with longitudinal axis normal to said discs at centers, with side of one said discs, opposite from where said stem is connected, having a shallow recessed area suitable for receiving said spherical game pieces.

3. Magnetic marbles stacking game and apparatus therefor as in claim 1, wherein said support structure means is in the form of a cup in inverted orientation, with the outer bottom side of said cup having a shallow recessed area suitable for receiving spherical game pieces.

4. Magnetic game pieces stacking game and apparatus therefor, for individuals and competing players, comprising:

an upright support structure means used to form an elevated, shallow recessed area with general horizontally orientated surface and surounding rim, suitable for receiving small game pieces;

a plurality of magnetic game pieces, with each of said game pieces exerting a magnetic field strong enough to attract and attach to other said game pieces in the immediate vicinity;

whereby said players, following rules of game play, can compete with each other in a number of game variations in which players take turns in seeing how many of said game pieces they can stack onto and above said recessed area of said support means before a fall of any of said games pieces from said stack arrangement occurs, with the one of said players stacking most of said game pieces before said fall occurs being the winner.

5. Magnetic game pieces stacking game and apparatus therefor as in claim 4, wherein said support structure means is a spool formed by two discs, generally parallel and connected by a stem with longitudinal axis normal to said discs at center, with side of one of said discs, opposite from where said stem is connected, having a shallow recessed area suitable for receiving said game pieces.

6. Magnetic game pieces stacking game and apparatus therefor as in claim 4, wherein said support structure means is in the form of a cup in inverted orientation, with the outer bottom side of said cup having a shallow recessed area suitable for receiving said game pieces.

* * * * *